United States Patent [19]

Gangi

[11] 4,086,791

[45] May 2, 1978

[54] REVERSE RACKING MECHANISM FOR WARP KNITTING MACHINE

[75] Inventor: Robert J. Gangi, Emerson, N.J.

[73] Assignee: Joan Manufacturing Corporation, Waldwick, N.J.

[21] Appl. No.: 817,923

[22] Filed: Jul. 22, 1977

[51] Int. Cl.[2] ..... D04B 23/00

[52] U.S. Cl. ..... 66/207

[58] Field of Search ..... 66/203, 207, 204, 87

[56] References Cited

U.S. PATENT DOCUMENTS

| | | | |
|---|---|---|---|
| 1,431,828 | 10/1922 | Markman | 66/207 |
| 1,486,780 | 3/1924 | Maxik | 66/126 R |
| 1,559,962 | 11/1925 | Heinitz | 66/126 |
| 3,446,039 | 5/1969 | Schmid | 66/207 |
| 3,762,184 | 10/1973 | Schur et al. | 66/154 A |

OTHER PUBLICATIONS

Brown, "507 Mechanical Movements", N.Y., Brown, 1903, pp. 1, 34, 35.

*Primary Examiner*—Ronald Feldbaum

*Attorney, Agent, or Firm*—Bell, Seltzer, Park & Gibson

[57] ABSTRACT

This reverse racking mechanism is particularly adapted for use with warp knitting machines of the type including inlay yarn guide tubes supported on carrier rods with each of the carrier rods being racked or shogged by a separate pattern chain to form various types of zig-zag patterns on the knit fabric. As step-by-step racking movement is imparted to a particular carrier rod, the present mechanism imparts the same racking movement in a reverse direction to an adjacent carrier rod. The present mechanism includes rack means carried by the adjacent carrier rods with a pinion supported between and in engagement with the two racks so that any racking movement imparted to one carrier rod is imparted to the adjacent carrier rod but in a reverse direction.

5 Claims, 5 Drawing Figures

REVERSE RACKING MECHANISM FOR WARP KNITTING MACHINE

This invention relates generally to a reverse racking mechanism for warp knitting machines and more particularly to such a mechanism which provides that the identical racking movement in the reverse direction will be imparted to an adjacent carrier rod.

In many warp knitting machines, each individual carrier rod is controlled for racking movement by an individual pattern chain so that a pattern chain must be prepared for each carrier rod when a new pattern is to be knit on the knitting machine. It has been proposed, as illustrated in U.S. Pat. No. 2,233,664, to connect adjacent carrier rods with a steel band passing around a pulley so that any motion imparted to one carrier rod will be transmitted to the adjacent carrier rod but in a reverse direction. While this type of mechanism will impart reverse movement to an adjacent carrier rod, positive racking of the adjacent carrier rod in both directions cannot be achieved.

With the foregoing in mind, it is an object of the present invention to provide a reverse racking mechanism which acts in a positive and accurate manner to transmit reverse racking movement from one carrier rod to an adjacent carrier rod when step-by-step racking movement is taking place in both directions.

In accordance with the present invention, first rack means is supported for longitudinal adjustment on first carrier rod means to which racking or shogging movement is to be imparted and second rack means is supported for longitudinal adjustment on second carrier rod means. A pinion is supported for rotation between and in engagement with the first and second rack means so that any movement imparted to the first carrier rod means will be positively and accurately imparted to the second carrier rod means but in a reverse direction. Because of the positive connection between the first and second carrier rod means, the reverse racking movements will be transmitted to the second carrier rod means in both directions.

Other objects and advantages will appear as the description proceeds when taken in connection with the accompanying drawings, in which FIG. 1 is a fragmentary, somewhat schematic, front elevational view of a warp knitting machine with the present reverse racking mechanism associated with the left-hand end of adjacent carrier rods;

Figure 1:
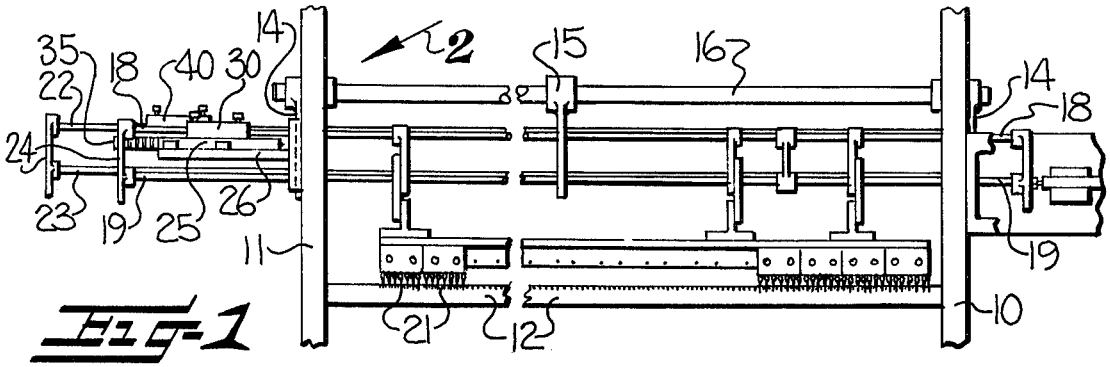
Figure 2:
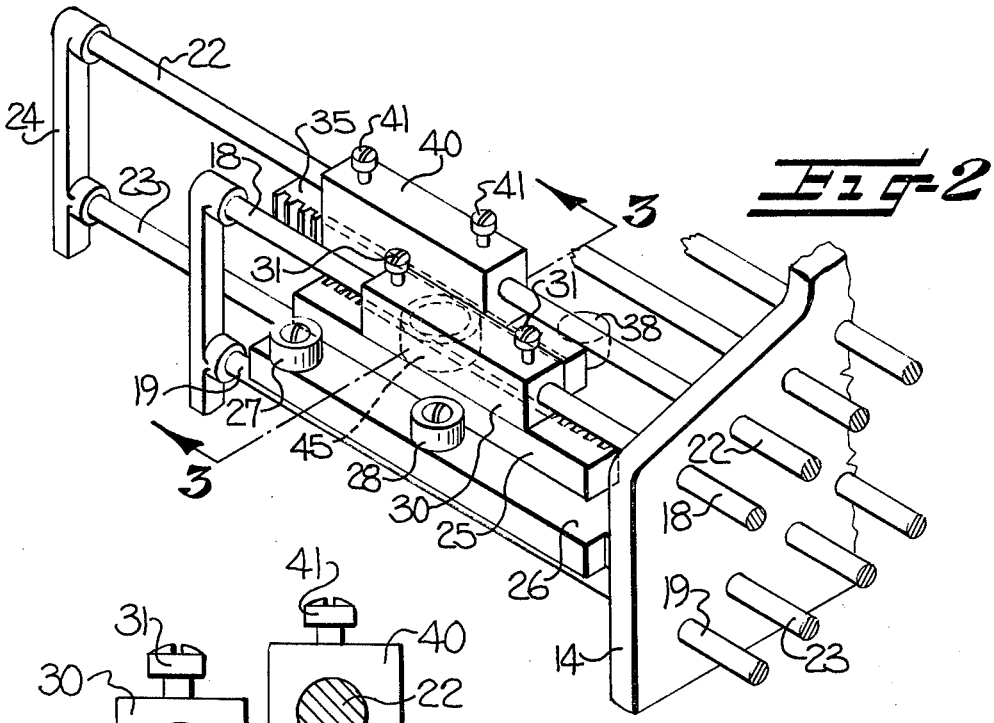
FIG. 2 is an enlarged fragmentary isometric view illustrating the reverse racking mechanism and being taken substantially in the direction of the arrow 2 in FIG. 1.
Figure 3:
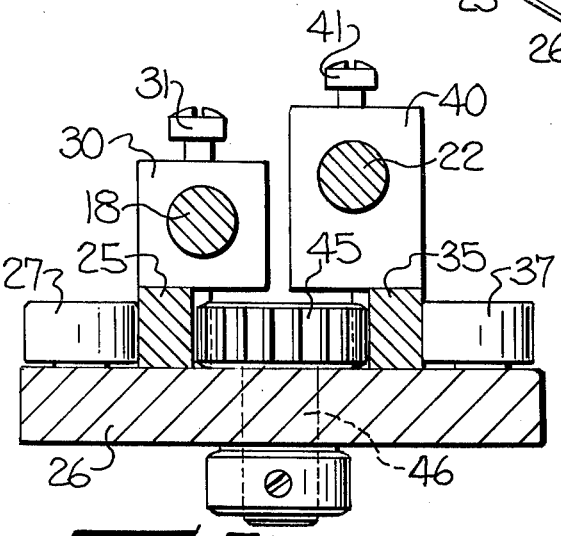
FIG. 3 is a transverse vertical sectional view through the reverse racking mechanism and being taken substantially along the line 3—3 in FIG. 2.

The reverse racking mechanism of the present invention is illustrated in association with a warp knitting machine of the type manufactured by Cidega Machine Manufacturing Co. However, it is to be understood that the reverse racking mechanism of the present invention may also be used in connection with other types of warp knitting machines which include weft inlay yarn guide tubes or bars.

The knitting machine includes spaced apart end frames 10, 11 which are spanned by a needle bed in which the usual needles, not shown, are supported for horizontal reciprocation. Guide plates 14 are supported for vertical movement on each end frame 10, 11 and support the opposite end portion of a plurality of inlay yarn guide carrier rods for longitudinal movement therein. One or more intermediate carrier rod guide plates 15 is also supported intermediate the end frames 10, 11 and the carrier rod guide plates 14, 15 are supported at their upper ends on a support shaft 16.

First carrier rod means, in the form of a pair of vertically spaced parallel carrier rods 18, 19, extends across the machine and operate weft yarn guide tubes 21 suitably supported thereby. As is well known, the needles form chains of stitch loops of ground or base yarns and pattern yarns are selectively fed through the guide tubes 21 to inlay various designs on one face of the knit fabric. Second carrier rod means, in the form of a pair of vertically spaced parallel carrier rods 22, 23, extends across the machine and operate weft yarn guide tubes, not shown. The second carrier rods 22, 23 are supported for longitudinal racking movement adjacent to the first carrier rods 18, 19. The end portions of the carrier rods 18, 19 and 22, 23 extend outwardly beyond the end frame 11 and the ends of the pairs of carrier rods are connected together by end brackets 24.

The means for imparting step-by-step shogging or racking movement to the second carrier rods 22, 23 and in a reverse direction from the step-by-step racking movement imparted to the first carrier rods 18, 19 includes first rack means, in the form of a rack 25, supported for longitudinal sliding movement on a support plate 26, one end of which is fixed to the guide plate 14. The support plate 26 is positioned between the upper carrier rods 18, 22 and the lower carrier rods 19, 23 and extends outwardly from the guide plate 14. Guide rollers 27, 28 are supported for rotation on the support plate 26 and engage the outer edge of the rack 25. An adjustment bracket or block 30 is fixed to the upper edge of the rack 25 and surrounds the upper carrier rod 18. The block 30 is fixed in adjusted position on the carrier rod 18 by screws 31.

Second rack means, in the form of a rack 35, is supported for longitudinal sliding movement on the plate 26 and guide rollers 37, 38 are supported for rotation on the plate 26 and engage the outer edge of the rack 35. An adjustment bracket or block 40 is fixed at its lower edge to the upper edge of the rack 35 and surrounds the upper carrier rod 22. The block 40 is fixed in adjusted position on the carrier rod 22 by screws 41.

A pinion 45 is supported for rotation between and with the teeth thereof in engagement with the racks 25, 35. The pinion 45 transmits step-by-step racking movement imparted to the first carrier rods 18, 19 to the second carrier rods 22, 23 and in a reverse direction. The pinion 45 is supported for rotation on a stub shaft 46 which is fixed in the support plate 26.

Figure 4:
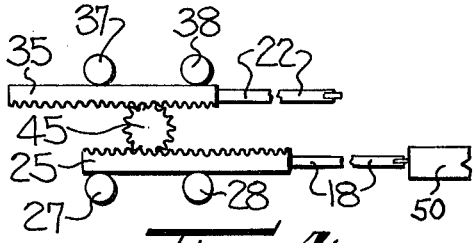
FIG. 4 is a schematic plan view of the reverse racking mechanism.
Figure 5:
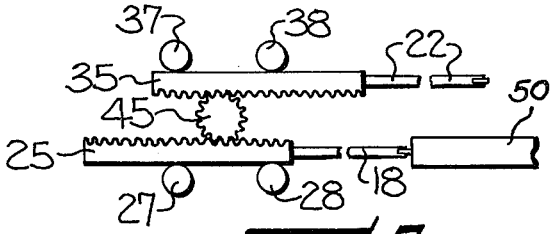
FIG. 5 is a view similar to FIG. 4 but showing the racks and associated carrier rods being moved to a different position.

A step-by-step racking movement can be imparted to the first carrier rods 18, 19 in any conventional manner, such as by a cam wheel, a pattern chain or the like, schematically illustrated at 50 in FIGS. 4 and 5. Any shogging or racking movement transmitted to the first carrier rods 18, 19 will be transmitted to the second carrier rods 22, 23 but in a reverse direction by means of the racks 25, 35 and pinion 45, as schematically illustrated in FIGS. 4 and 5. When the rack 25 is moved in a step-by-step manner from the position shown in FIG.

4 to the position shown in FIG. 5, like movement in the reverse direction will be imparted to the second carrier rods 22, 23 by means of the rack 35 and the interconnecting pinion 45. Thus, any movement imparted to the first carrier rods 18, 19 will be positively and accurately transmitted to the second carrier rods 22, 23 but in a reverse direction. Accordingly, a single pattern mechanism, such as a pattern link 50 (FIGS. 4 and 5), can be utilized to impart various types of reversing zig-zag patterns to adjacent carrier rods so that various types of inlaid patterns, such as diamonds and the like, may be formed on the knit fabric. With the present reversing mechanism, it is only necessary to change one pattern device to set up a different type of knitting pattern with adjacent carrier rods being racked in opposite directions.

In the drawings and specification there has been set forth a preferred embodiment of the invention, and although specific terms are employed, they are used in a generic and descriptive sense only and not for purposes of limitation, the scope of the invention being defined in the claims.

That which is claimed is:

1. In a warp knitting machine including a row of needles, adjacent first and second carrier rod means supported for parallel movement relative to said needles, weft inlay yarn feed means carried by each of said first and second carrier rod means, and pattern control means for imparting step-by-step racking movement to said first carrier rod means for inlaying weft yarns in the knit fabric, the combination therewith of means for imparting step-by-step racking movement to said second carrier rod means and in a reverse direction from the step-by-step movement imparted to said first carrier rod means, said means comprising (a) first rack means carried by said first carrier rod means and being movable with said first carrier rod means, (b) second rack means carried by said second carrier rod means and being operable to move said second carrier rod means, and (c) a pinion supported in a fixed position for rotation between and in engagement with said first and second rack means said pinion being rotated when said pattern control means inparts step-by-step racking movement to said first carrier rod means and to said first rack means to thereby transmit a similar racking movement but in a reverse direction to said second rack means and to said second carrier rod means.

2. A warp knitting machine according to claim 1 including a pair of spaced apart end frames, and a carrier guide plate supported in each of said end frames with opposite end portions of said first and second carrier rod means supported for longitudinal sliding movement therein and extending outwardly therefrom, and wherein said reverse racking movement means includes a support plate having one end fixed on one of said carrier guide plates and extending outwardly therefrom, and wherein said pinion is supported for rotation on said support plate.

3. A warp knitting machine according to claim 2 wherein said first and second carrier rod means each comprises spaced apart upper and lower carrier rods, and wherein said support plate is positioned between said upper and lower carrier rods and also slidably supports said first and second rack means on opposite sides of said pinion.

4. A warp knitting machine according to claim 3 including guide rollers supported on said support plate and in engagement with each of said first and second rack means to maintain the same in engagement with said pinion.

5. A warp knitting machine according to claim 4 including means for longitudinally adjusting said first and second rack means on said respective first and second carrier rod means, said adjusting means comprising first and second adjustment blocks supported for longitudinal movement on said corresponding carrier rods, means for maintaining said adjustment blocks in adjusted position on said carrier rods, and means fixedly connecting said adjustment blocks to said corresponding first and second rack means.

* * * * *